US010020555B2

(12) United States Patent
Sarkar et al.

(10) Patent No.: US 10,020,555 B2
(45) Date of Patent: Jul. 10, 2018

(54) RECONFIGURABLE 1:N WILKINSON COMBINER AND SWITCH

(71) Applicant: AVAGO TECHNOLOGIES GENERAL IP (SINGAPORE) PTE. LTD., Singapore (SG)

(72) Inventors: Saikat Sarkar, Irvine, CA (US); Seunghwan Yoon, Irvine, CA (US); Bagher Afshar, Irvine, CA (US); Michael Boers, South Turramurra (AU); Jesus Castaneda, Long Beach, CA (US); Tirdad Sowlati, Irvine, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 311 days.

(21) Appl. No.: 14/854,832

(22) Filed: Sep. 15, 2015

(65) Prior Publication Data

US 2017/0047667 A1 Feb. 16, 2017

Related U.S. Application Data

(60) Provisional application No. 62/205,547, filed on Aug. 14, 2015.

(51) Int. Cl.

| | |
|---|---|
| ***H01Q 3/00*** | (2006.01) |
| ***H01P 5/16*** | (2006.01) |
| ***H01P 1/15*** | (2006.01) |

(52) U.S. Cl.

CPC . *H01P 5/16* (2013.01); *H01P 1/15* (2013.01)

(58) Field of Classification Search

CPC ..... H01Q 3/00; H01P 5/16; H01P 1/15

See application file for complete search history.

(56) References Cited

U.S. PATENT DOCUMENTS

| | | | | |
|---|---|---|---|---|
| 4,472,691 | A * | 9/1984 | Kumar | H01P 1/15 327/434 |
| 5,243,354 | A * | 9/1993 | Stern | H01Q 3/242 333/1.1 |
| 5,247,310 | A * | 9/1993 | Waters | H01Q 3/22 342/368 |
| 6,252,512 | B1 * | 6/2001 | Riley | G01L 1/162 340/665 |
| 8,838,036 | B2 | 9/2014 | Yoon et al. | |
| 9,218,918 | B2 * | 12/2015 | Lauraire | H01H 1/2016 |
| 2008/0100510 | A1 * | 5/2008 | Bonthron | G01S 7/024 342/373 |
| 2008/0258993 | A1 * | 10/2008 | Gummalla | H01Q 1/243 343/876 |

(Continued)

FOREIGN PATENT DOCUMENTS

| | | | | |
|---|---|---|---|---|
| CN | 102646874 | A * | 8/2012 | |
| FR | 2958086 | A1 * | 9/2011 | H01Q 3/247 |

*Primary Examiner* — Harry K Liu

(74) *Attorney, Agent, or Firm* — Oblon, McClelland, Maier & Neustadt, L.L.P.

(57) ABSTRACT

An electronic device includes circuitry configured to determine an antenna operation mode for one or more antenna arrays. The circuitry is further configured to control the one or more antenna arrays to operate in a combined antenna mode via a Wilkinson combiner. The circuitry is also configured to control the one or more antenna arrays to operate in an isolated antenna mode via a single-pole, multi-throw switch.

17 Claims, 14 Drawing Sheets

(56) References Cited

U.S. PATENT DOCUMENTS

| | | | | |
|---|---|---|---|---|
| 2014/0139373 | A1* | 5/2014 | Tseng | H01Q 3/36<br>342/374 |
| 2015/0123873 | A1 | 5/2015 | Perumana et al. | |

* cited by examiner

RECONFIGURABLE 1:N WILKINSON COMBINER AND SWITCH

CROSS-REFERENCE TO RELATED APPLICATIONS

The present application claims the benefit of the earlier filing date of U.S. provisional application 62/205,547 having common inventorship with the present application and filed in the U.S. Patent and Trademark Office on Aug. 14, 2015, the entire contents of which being incorporated herein by reference.

BACKGROUND

Technical Field

The present disclosure is directed to phased array communication systems, including IEEE 802.11ad systems.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Phased array communication systems typically use an antenna array that includes M antenna elements. However, some communication systems, such as the IEEE 802.11ad (60 GHz) systems have spatial diversity requirements that demand the use of N antenna arrays having M/N antenna elements in each array.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
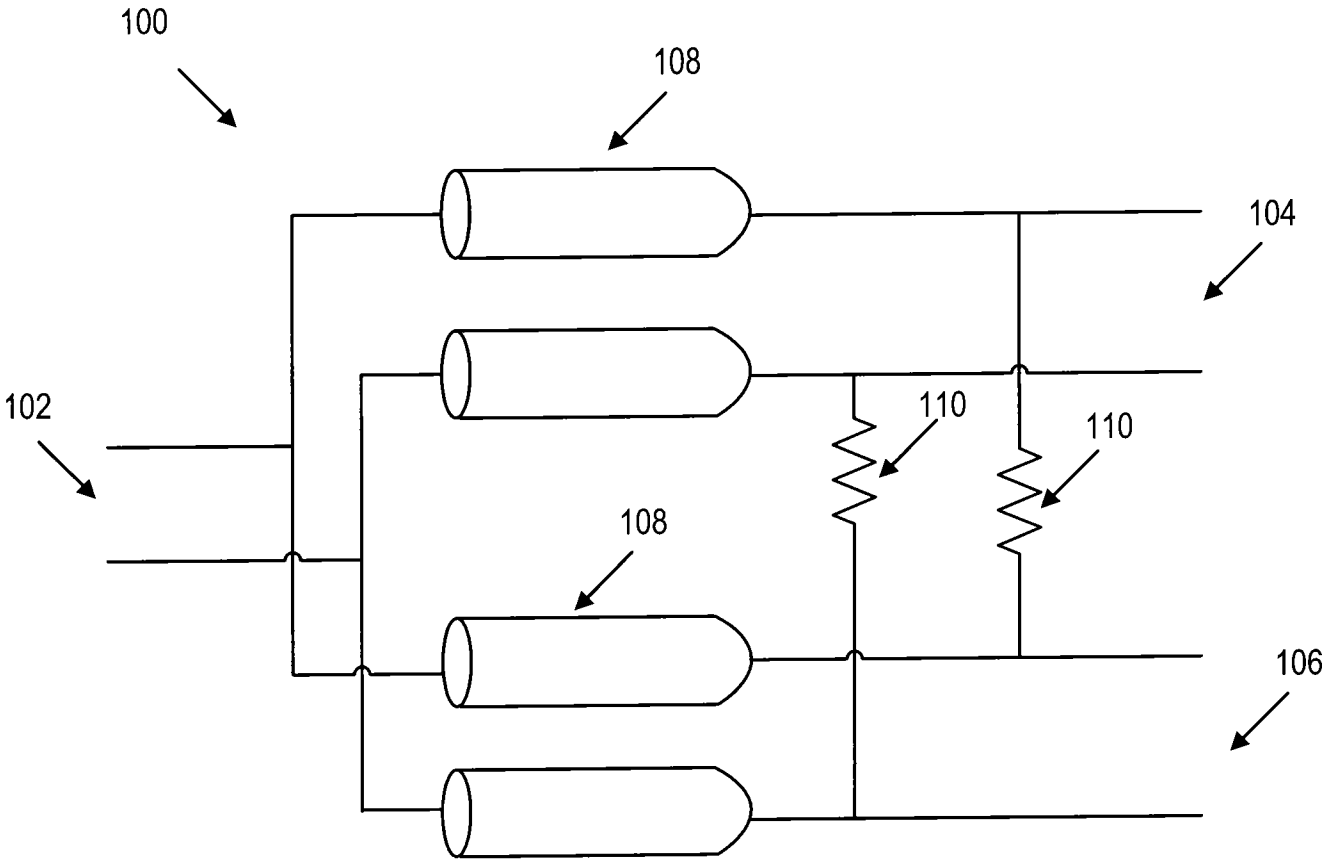
Fig. 1 Related Art
FIG. 1 is an exemplary schematic diagram of a related art 1:2 Wilkinson combiner, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

In an exemplary embodiment, an electronic device includes circuitry configured to determine an antenna operation mode for one or more antenna arrays. The circuitry is further configured to control the one or more antenna arrays to operate in a combined antenna mode via a Wilkinson combiner. The circuitry is also configured to control the one or more antenna arrays to operate in an isolated antenna mode via a single-pole, multi-throw switch.

In another exemplary embodiment, a method includes determining an antenna operation mode for one or more antenna arrays; controlling the one or more antenna arrays to operate in a combined antenna mode via a Wilkinson combiner; and controlling the one or more antenna arrays to operate in an isolated antenna mode via a single-pole, multi-throw switch.

In another exemplary embodiment, a device includes circuitry configured to align one or more Wilkinson combiners in series or parallel to provide power to one or more antenna arrays, and align one or more single-pole, multi-throw switches in series or parallel to isolate an operational antenna array from one or more non-operational antenna arrays.

FIG. 1 is an exemplary schematic diagram of a related art 1:2 Wilkinson combiner 100, according to certain embodiments. The Wilkinson combiner 100 has one input port 102 and two isolated output ports 104 and 106. The input port 102 and the output ports 104 and 106 are connected via quarter wavelength ($\lambda/4$) transmission lines 108 having impedances equal to 1.4 times a system impedance, $Z_0$. In addition, the output ports 104 and 106 are connected via resistors 110, and the individual resistors 110 have impedances equal to the system impedance, $Z_0$. Therefore, the impedances at the input port 102 and output ports 104 and 106 are also matched to the system impedance, $Z_0$.

Because the Wilkinson combiner 100 includes passive components, the Wilkinson combiner 100 can be configured for bi-directional power transfer. For example, the Wilkinson combiner 100 can function as either a power combiner or a power divider. In addition, the Wilkinson combiner 100 can be implemented in a radio with a phased array transceiver. When operating as a phased array transmitter, the Wilkinson combiner 100 divides electrical power at the input port 102 equally between two antenna arrays connected to the output ports 104 and 106. In one implementation, the antenna arrays each have M antennas. In addition, when operating as a phased array receiver, the Wilkinson combiner 100 combines radio signals received by the antenna arrays connected to output ports 104 and 106 into one signal, which is transferred to the input port 102 for further processing by the radio.

Figure 2:
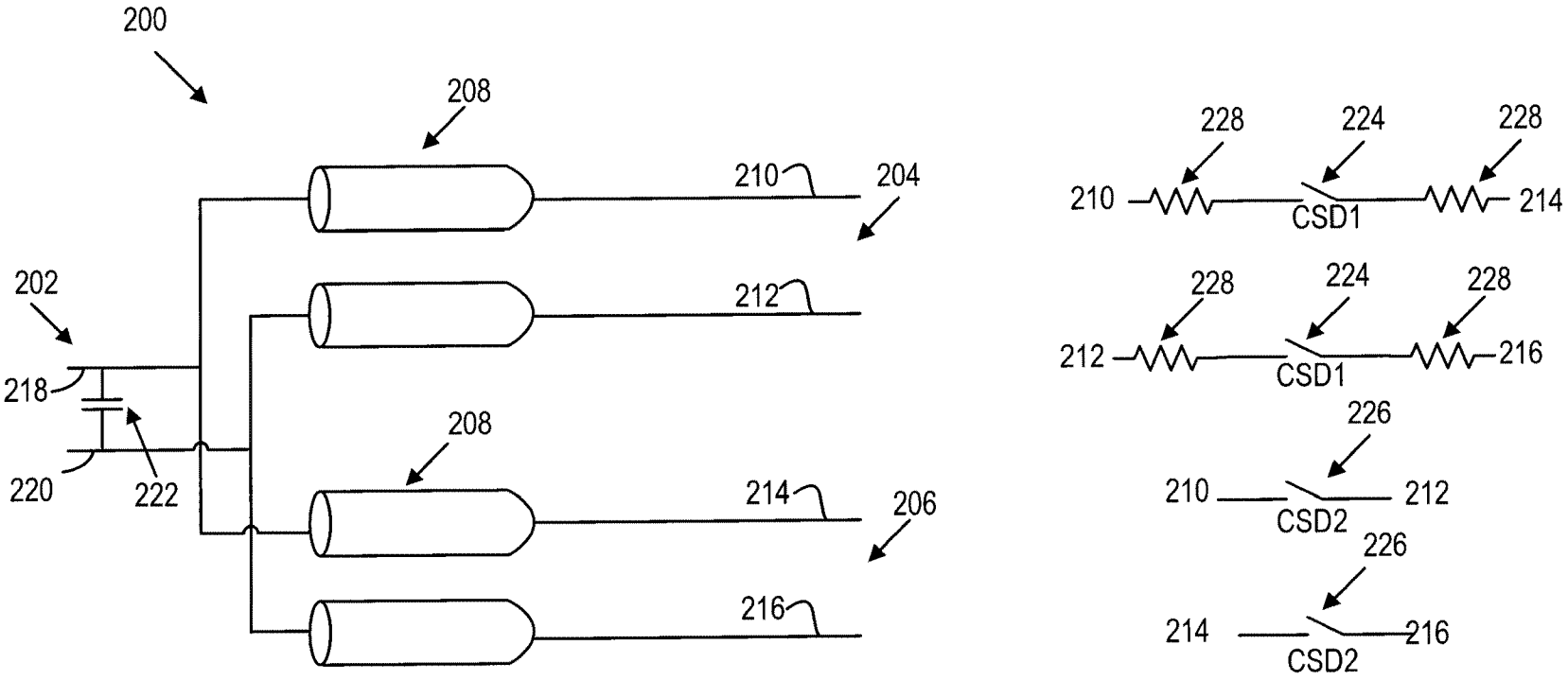
FIG. 2 is an exemplary schematic diagram of a combiner/switch device, according to certain embodiments.

FIG. 2 is an exemplary schematic diagram of a combiner/switch device 200, according to certain embodiments. The combiner/switch device 200 can be implemented in a radio chip operating in a mobile device, cellular backhaul device, or any other device configured for wireless communications. In some implementations, the combiner/switch device 200 has one input port 202 and two isolated output ports 204 and 206. The input port 202 and the output ports 204 and 206 are connected via quarter wavelength ($\lambda/4$) transmission lines 208 having impedances equal to 1.4 times the system impedance, $Z_0$.

The combiner/switch device 200 uses differential signaling such that each port of the combiner/switch device 200 includes two complementary signal lines. For example, the output port 204 includes differential signal lines 210 and 212, and the output port 206 includes differential signal lines 214 and 216. In addition, the input port 202 includes differential signal lines 218 and 220, which are connected via capacitor 222. In other implementations, the combiner/switch device 200 can use single-ended signaling where the input port 202 and output ports 204 and 206 have individual signal lines as well as a common ground line that is shared by all of the ports of the combiner/switch device 200.

According to certain embodiments, the output ports 204 and 206 of the combiner/switch device 200 are connected via one or more resistors and/or switches. In some implementations, the switches are core switching devices (CSDs) that are designed to achieve impedance matching at the input port 202 and the output ports 204 and 206. Details regarding the CSDs and the impedance matching of the input port 202 and output ports 204 and 206 are discussed further herein. A first type of CSD (CSD1) 224 having a first impedance is designed to connect corresponding signal lines for each of the output ports 204 and 206 via resistors 228. For example, signal line 210 of the output port 204 and the signal line 214 of the output port 206 are connected via the CSD1 224 and the resistors 228. Likewise, the signal line 212 of the output port 204 and the signal line 216 of the output port 216 are also connected via the CSD1 224 and the resistors 228. A second type of CSD (CSD2) 228 having a second impedance connects the differential signal lines at each output port 204 and 206. For example, a CSD2 228 connects the differential signal lines 210 and 212 for the output port 204 as well as the differential signal lines 214 and 216 for the output port 206.

According to some implementations, the combiner/switch device 200 can be configured for antenna operation modes that include a combined antenna mode or an isolated antenna mode. Like the Wilkinson combiner 100, the combiner/switch device 200 can also be implemented in a radio having a phased array transceiver and can be configured for bi-directional power transfer as a transmitter and/or receiver. For example, in the combined antenna mode, the combiner/switch device 200 operates as a 1:2 Wilkinson combiner that can be a power combiner or a power divider to divide signals being transmitted by the antenna arrays or combine received signals. To align the combiner/switch device 200 for the combined antenna mode, processing circuitry of a radio can issue a control signal to close or turn on both of the CSD1s 224 of the combiner/switch device 200 so that the combiner/switch device 200 functions as the 1:2 Wilkinson combiner. The CSD2s 226 of the combiner/switch device 200 remain open in the combined antenna mode. The combined antenna mode can be implemented when performance specifications of the radio include increasing antenna coverage and/or achieving spatial diversity specifications for wireless communication systems, such as IEEE 802.11ad systems.

In the isolated antenna mode, the combiner/switch device 200 operates as a single-pole, double-throw (SPDT) switch that transfers power between the input port 202 and one of the output ports 204 or 206. Therefore, the combiner/switch device 200 isolates an operational antenna array from a non-operational antenna array. Throughout the disclosure, the SPDT can also be referred to as a single-pole, multi-throw switch having one input and N outputs. As will be discussed further herein, configuring the combiner/switch device 200 for isolated antenna mode can result in reduced insertion losses and matching losses as compared to the combiner/switch device 200 operating in the combined antenna mode. To align the combiner/switch device 200 for the isolated antenna mode, the processing circuitry of the radio can issue a control signal to close one of the CSD2s 226 of the combiner/switch device 200 so that the combiner/switch device 200 functions as a SPDT switch. For example, the CSD2 226 connecting the differential signal lines 210 and 212 is shut to align power to an antenna array connected to the output port 204. Likewise, the CSD2 226 connecting the differential signal lines 214 and 216 is shut to align power to the antenna array connected to the output port 206. The CSD1s 224 remain open during the isolated antenna mode, and the CSD2 226 associated with a non-operational antenna array also remains open.

Component impedance values for the combiner/switch device 200, including the CSD1s 224, CSD2s 226, resistors 228, and capacitor 222 can be designed so that impedances at both the input port 202 and output ports 204 and 206 are matched to the system impedance in both the combined antenna mode and the isolated antenna mode. The port impedances may be matched to the system impedance within a predetermined impedance threshold, such as 1.5 times the system impedance. In one implementation, where the CSD1s 224 and CSD2s 226 are assumed to be ideal switches, the impedances of the input port 202 and output ports 204 and 206 may be matched to the system impedance, $Z_0$, in the combined antenna mode. For example, the total impedance from the two resistors 228 and one on-state CSD1 224 connected in series is equal to the system impedance, $Z_0$. In addition, the capacitance of the capacitor 222 is also equal to the system impedance, $Z_0$. However, in the isolated antenna mode, the impedance at the input port 202 and output ports 204 and 206 is equal to twice the system impedance, $Z_0$, which is greater than the predetermined impedance threshold, resulting in impedance mismatch. The impedance mismatch can lead to unwanted behavior of the combiner/switch device 200, including reflection, power loss, and the like.

In another implementation where the CSD1s 224 and CSD2s 226 may be assumed to be non-ideal switches, the impedances of the input port 202 and output ports 204 and 206 may be matched to 0.8 times the system impedance, $Z_0$, in the combined antenna mode, which results in impedance matching within the predetermined impedance threshold in the isolated antenna mode. For example, the total impedance from the two resistors 228 and one on-state CSD1 224 connected in series is equal to 0.8 times the system impedance, $0.8*Z_0$. In addition, in the isolated antenna mode, if the system impedance, $Z_0$, is equal to 50 ohm (Ω), and the on-state impedance of the CSD2s 226 is equal to 12Ω, the impedance at the input port 202 is equal to 52Ω, and the impedance at the output ports 204 and 206 is equal to 74Ω, which is within the predetermined impedance threshold of 1.5 times the system impedance, $Z_0$.

Figure 3:
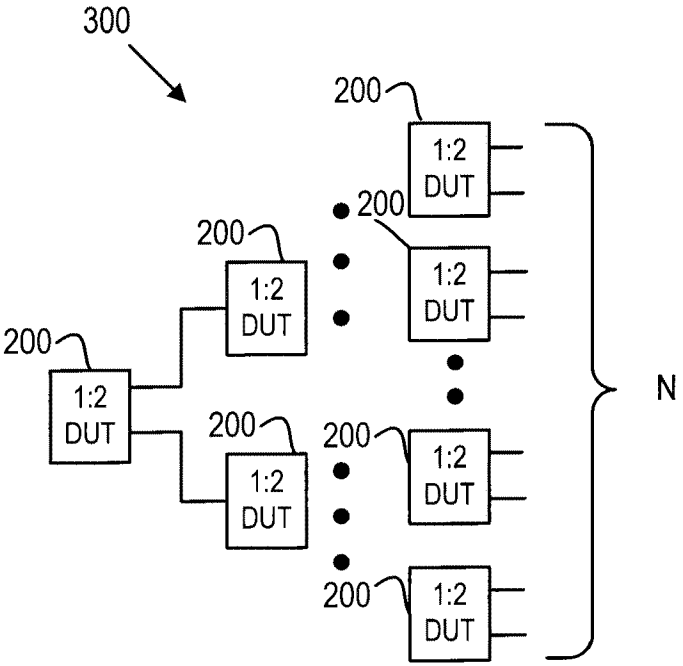
FIG. 3 is an exemplary schematic diagram of combiner/switch devices in series, according to certain embodiments.

FIG. 3 is an exemplary schematic diagram of cascaded series configuration 300 for combiner/switch devices, according to certain embodiments. To provide power to greater than two output ports, multiple combiner/switch devices 200 having the one input port 202 and two output ports 204 and 206 can be cascaded in series to produce one input port and a number output ports corresponding to a number of antenna arrays of a radio. For example, three 1:2 combiner/switch devices 200 can be cascaded in series to produce one input port and four output ports. The number of combiner/switch devices 200 can be increased to increase the total number of output ports to N output ports. According to certain embodiments, the cascaded series configuration 300 of the combiner/switch device 200 are referred to as a 1:N Wilkinson combiner in combined antenna mode and as a single-pole, multi-throw antenna having N outputs in the isolated antenna mode. Cascading multiple combiner/switch devices 200 in series compounds the total losses present in the combiner/switch device 200, which may increase an amount of transmit power and/or receive power to compensate for the losses.

In some implementations, radios have a plurality of antenna arrays that are configured operate at multiple carrier frequencies, modulation schemes, and the like. In addition, the antenna arrays can be configured based on coverage patterns for the radios via the cascaded combiner/switch devices 200. In some implementations, the processing circuitry of the radio issues control signals to align the combiner/switch devices 200 in the cascaded series configuration. In addition, like the example of the single combiner/switch device 200, the processing circuitry implements the combined antenna mode or the isolated antenna mode for the cascaded combiner/switch devices 200 by issuing control signals to open and close the CSD1s 224 and the CSD2s 226.

Figure 4A:
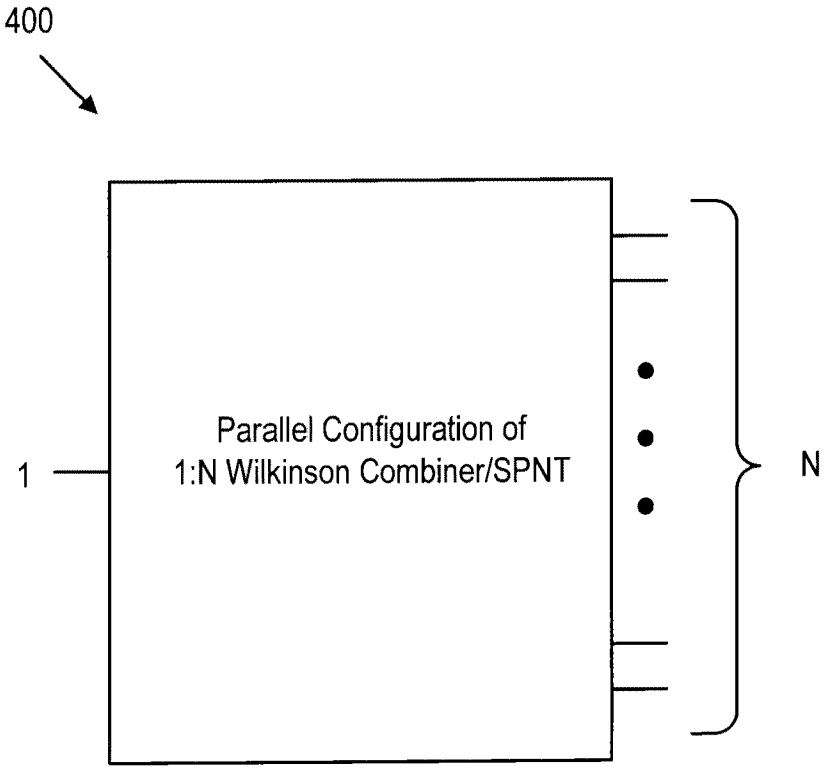
FIG. 4A is an exemplary schematic diagram of combiner/switch devices in parallel, according to certain embodiments.

FIG. 4A is an exemplary schematic diagram of a parallel configuration for the combiner/switch, according to certain embodiments. Like the cascaded series configuration 300, the parallel configuration allows the combined antenna mode and the isolated antenna mode to be implemented for greater than two antenna arrays. However, the parallel configuration of the combiner/switch includes a single combiner/switch device 400 that has one input and N outputs. The combiner/switch device 400 includes two or more 1:2 Wilkinson combiners having a common input port and two more output ports connected in parallel. Like the combiner/switch device 200, the combiner/switch device 400 includes CSDs connecting the output ports of the combiner/switch device 400 to allow the combiner/switch device 400 to be aligned for the combined antenna mode or the isolated antenna mode.

Figure 4B:
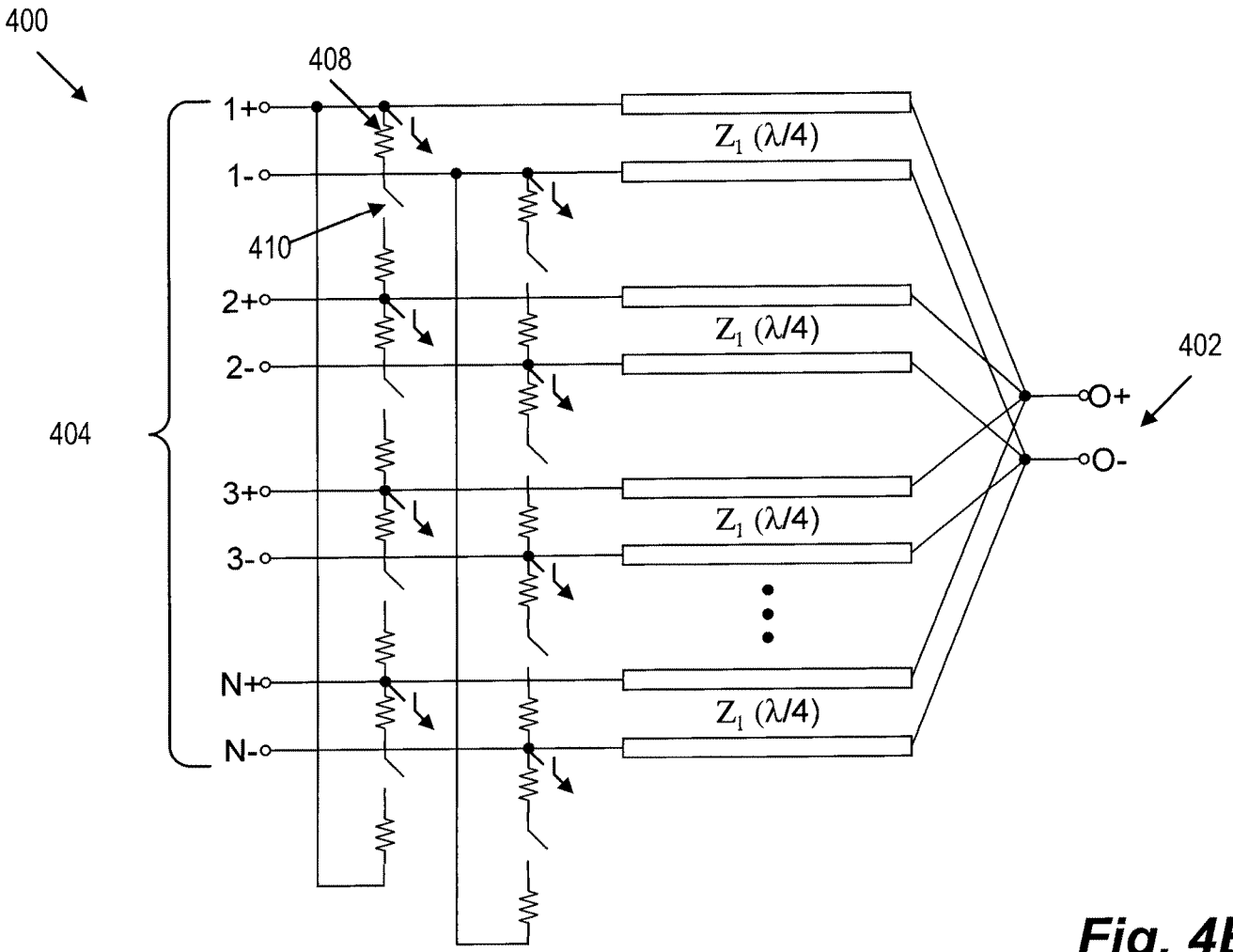
FIG. 4B is a detailed schematic diagram of combiner/switch devices in parallel, according to certain embodiments.

FIG. 4B is a detailed schematic diagram of a parallel configuration of the combiner/switch device, according to certain embodiments. The schematic diagram shown in FIG. 4B is an exemplary implementation of the combiner/switch device 400 where N−1 1:2 Wilkinson combiners are connected in parallel with a common input port 402 and N differential output ports 404. In addition, the input port 402 is connected to the N output ports 404 via N sets of quarter wavelength (λ/4) transmission lines 406. According to some implementations, the differential output ports 404 are connected by series-connected resistors 408 and CSDs 410. The processing circuitry of the radio issues control signals to operate the CSDs 410 to implement the combined antenna mode and/or the isolated antenna mode of the combiner/switch device 400. The CSDs 410 include both CSD1s to configure the combiner/switch device 400 for the combined antenna mode and the CSD2s to configure the combiner/switch device 400 for the isolated antenna mode.

Figure 5:
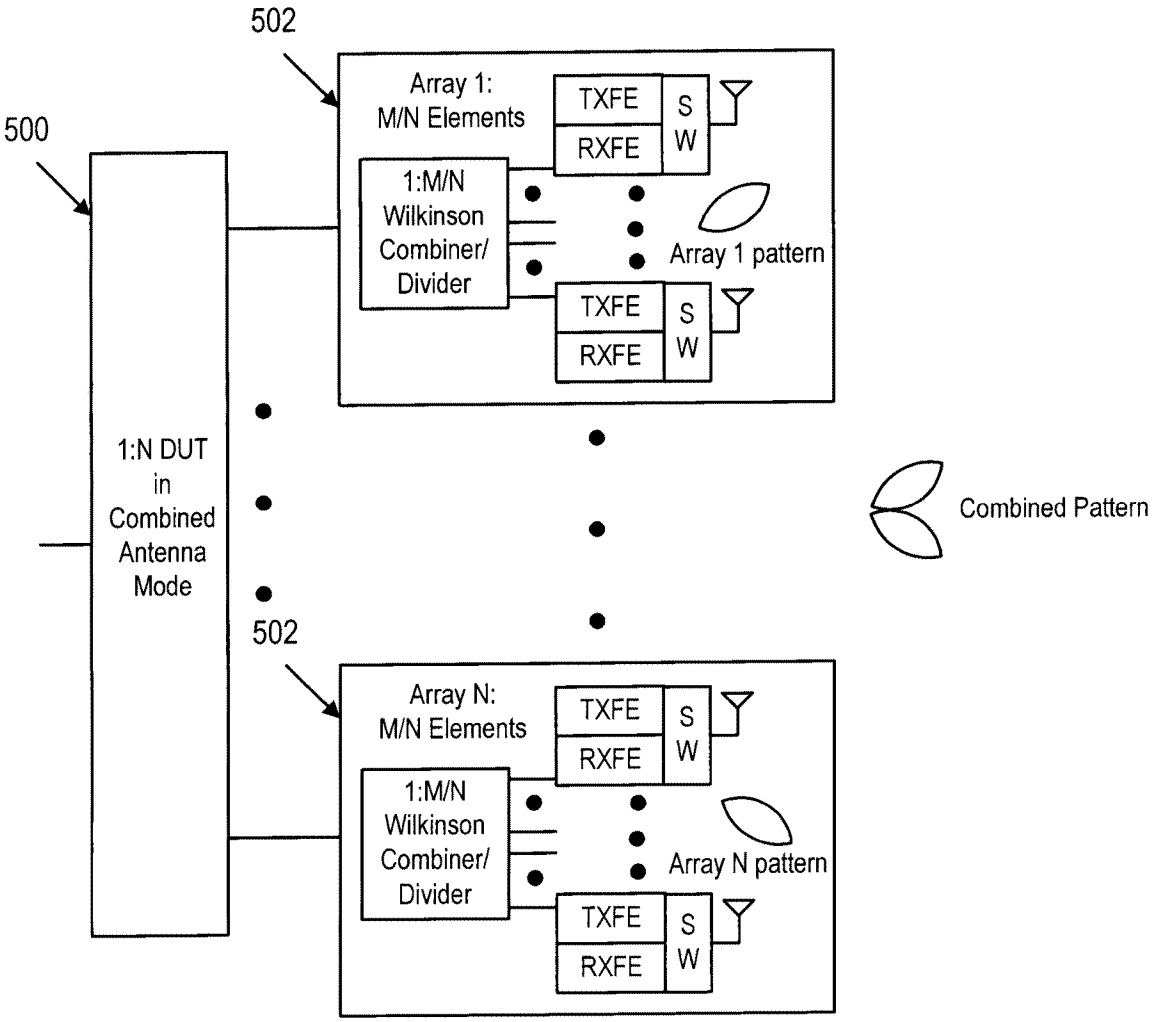
FIG. 5 is an exemplary schematic diagram of antenna arrays operating in combined antenna mode, according to certain embodiments.

FIG. 5 is an exemplary schematic diagram of antenna arrays operating in the combined antenna mode, according to certain embodiments. The 1:N combiner/switch device 500 operating in combined antenna mode is connected to N antenna arrays 502 having M/N antenna elements per array, resulting in a total of M antenna elements. The 1:N combiner/switch device 500 can be implemented as the combiner/switch device 200, combiner/switch device 300, combiner/switch device 400, or any other implementation where 1 input port is connected to N output ports via a 1:N Wilkinson combiner. Each antenna array 502 includes a 1:M/N Wilkinson combiner/divider to divide and/or combine power among the M/N antenna elements. Each antenna element has a corresponding front end that includes a transmitter front end (TXFE), receiver front end (RXFE), and switch (SW) to switch between transmitting and receiving.

When the N antenna arrays 502 are operating as transmitters in the combined antenna mode, the 1:N combiner/switch device 500 equally divides power between the N antenna arrays 502. In one implementation, each antenna array 502 is configured to output a corresponding unique antenna pattern, which results in the output of a total antenna pattern that includes all of the patterns from the N antenna arrays. In addition, when the N antenna arrays 502 are operating as receivers in the combined antenna mode, all of the M antenna elements associated with the N antenna arrays 502 are configured to simultaneously receive signals. For example, when a radio chip includes twelve antenna ports divided equally between three antenna arrays having four antenna elements, each of the antenna arrays 502 can be configured to simultaneously receive signals from three different directions. In addition, the processing circuitry of the radio can align the N antenna arrays 502 for the combined antenna mode based on one or more performance specifications, such as antenna coverage specifications and/or spatial diversity specifications.

Figure 6:
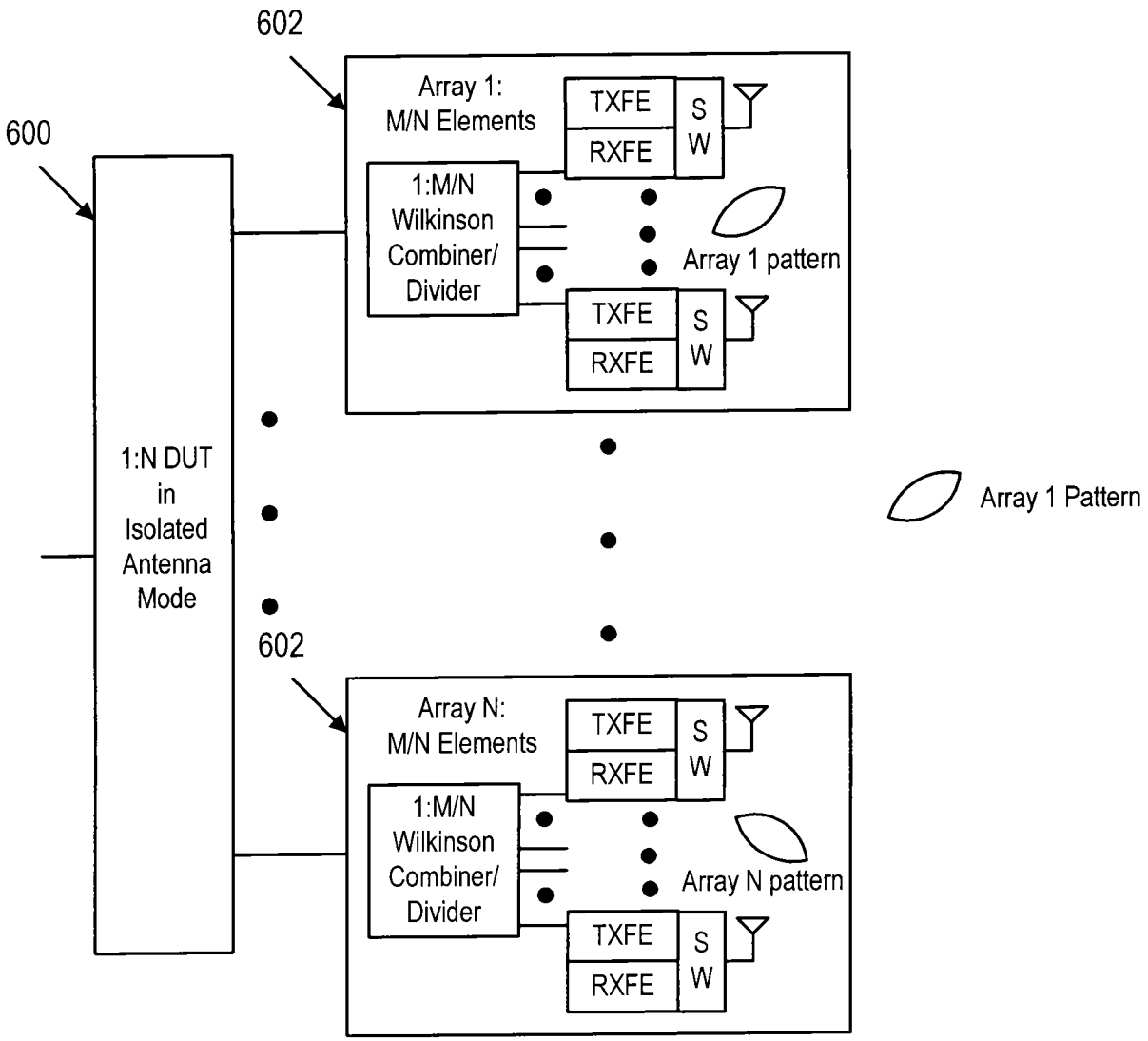
FIG. 6 is an exemplary schematic diagram of antenna arrays operating in isolated antenna mode, according to certain embodiments.

FIG. 6 is an exemplary schematic diagram of antenna arrays operating in isolated antenna mode, according to certain embodiments. The 1:N combiner/switch device 600 operating in isolated antenna mode is connected to N antenna arrays having M/N antenna elements per array, resulting in a total of M antenna elements. The 1:N combiner/switch device 600 can be implemented as the combiner/switch device 200, combiner/switch device 300, combiner/switch device 400, or any other implementation where 1 input port is connected to N output ports via a single-pole, multi-throw switch. As discussed previously, each antenna array 602 includes a 1:M/N Wilkinson combiner/divider to divide and/or combine power among the M/N antenna elements. Each antenna element has a corresponding front end that includes a transmitter front end (TXFE), receiver front end (RXFE), and switch (SW) to switch between transmitting and receiving.

When the N antenna arrays 602 are operating as transmitters in the combined antenna mode, the 1:N combiner/switch device 600 provides power to an operational antenna array and isolates the non-operational antenna arrays from the non-operational antenna array. In one implementation where each antenna array 602 is configured to output a corresponding unique antenna pattern, in the isolated antenna mode, the antenna pattern output from the radio corresponds to the antenna pattern of the operational array. In addition, when one antenna arrays 602 is operating as a receiver in the isolated antenna mode, the selected antenna array 602 is configured to receive signals. For example, a radio chip can include twelve antenna ports divided equally between three antenna arrays having four antenna elements. In one implementation, where the antenna arrays 602 are searching for an incoming beam form, the processing circuitry can cycle between each of the antenna arrays 602 in the isolated antenna mode at a predetermined frequency. When the incoming beam is detected via one of the antenna arrays 602, the processing circuitry can align the selected antenna array to perform a fine search for the incoming beam. In addition, the processing circuitry of the radio can align the N antenna arrays 602 for the isolated antenna mode based on one or more performance specifications, such as power consumption specifications. In some implementations, operating the N antenna arrays 602 in isolated antenna mode consumes less power than operating the N antenna arrays 602 in the combined antenna mode.

Figure 7A:
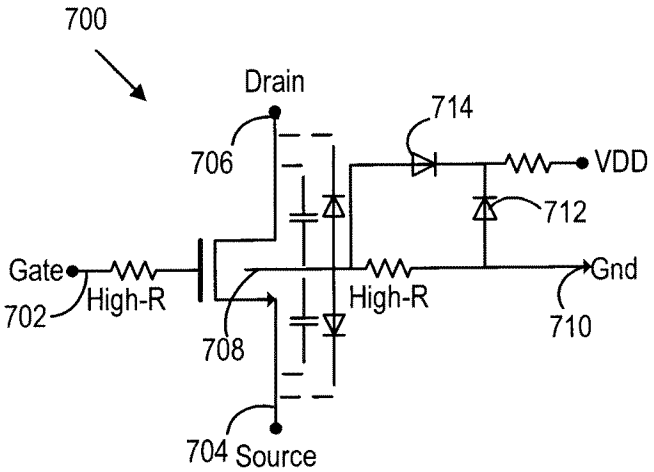
FIG. 7A is an exemplary schematic diagram of a related art deep N-well NFET device, according to certain embodiments.
Figure 7B:
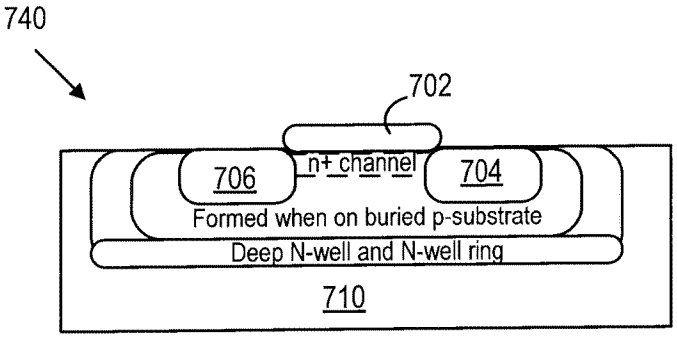
FIG. 7B is an exemplary illustration of a cross-section of a related art deep N-well NFET device, according to certain embodiments.

FIG. 7A is an exemplary schematic diagram of a related art deep N-well N-field-effect transistor (NFET) device 700, and FIG. 7B is an exemplary cross-section 740 of the related art deep N-well NFET device 700, according to certain embodiments. The NFET device 700 includes a gate 702 along with a source 704 and drain 706 in heavily doped n+ regions within a p-type substrate, and a n+ channel forms a conductive path between the source 704 and drain 706. The base 708 of the NFET device 700 is connected to ground, which is an external p-substrate material 710. In addition, a n-well bias (VDD) is applied at the outputs of diodes 712 and 714.

Figure 8A:
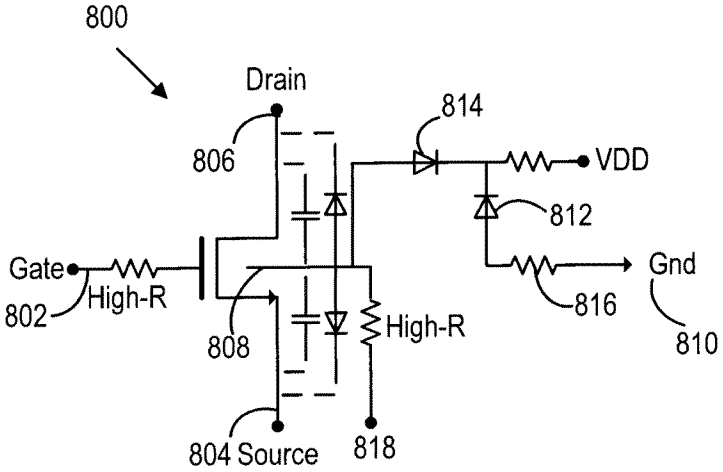
FIG. 8A is an exemplary schematic diagram of a deep N-well NFET device, according to certain embodiments.
Figure 8B:
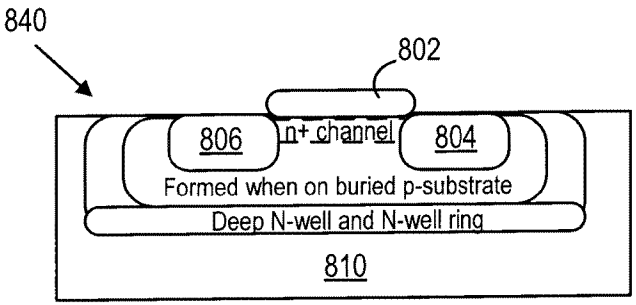
FIG. 8B is an exemplary illustration of a cross-section of a deep N-well NFET device, according to certain embodiments.

FIG. 8A is an exemplary schematic diagram of a deep N-well NFET device 800, and FIG. 8B is an exemplary illustration of a cross-section 840 of a deep N-well NFET device 800, according to certain embodiments. In some embodiments, the core switching devices (CSDs) described previously herein are implemented as the NFET device 800. The NFET device 800 shown in FIGS. 8A and 8B includes a structure that corresponds to the structure of the deep N-well NFET device 700. For example, the NFET device 800 includes a gate 802 along with a source 804 and drain 806 in heavily doped n+ regions within a p-type substrate, and a n+ channel forms a conductive path between the source 804 and drain 806. In addition, a n-well bias (VDD) is applied at the outputs of diodes 812 and 814.

However, the deep N-well NFET device 800 also includes a high-resistance p-substrate ring around the NFET device 800 at the external p-substrate that is illustrated in FIG. 8A as resistor 816 connected to ground, which is an external p-substrate material 810. The high-resistance p-substrate ring 816 reduces an impact of the capacitance of diode 812 at high frequencies, which increases an off-state impedance of the NFET device 800. The NFET device 800 also includes a buried p-substrate bias 822 separate from the external p-substrate that provides an additional conductive path between the drain 806 and source 804 other than the n+ channel. In some implementations, the buried p-substrate bias 818 is zero when the NFET device 800 is off and is VDD when the NFET device 800 is on. The additional the buried p-substrate bias 818 reduces an on-state impedance of the NFET device 800. The addition of the high-resistance p-substrate ring 816 and the buried p-substrate bias 818 reduces the total losses for the NFET device 800.

Figure 9:
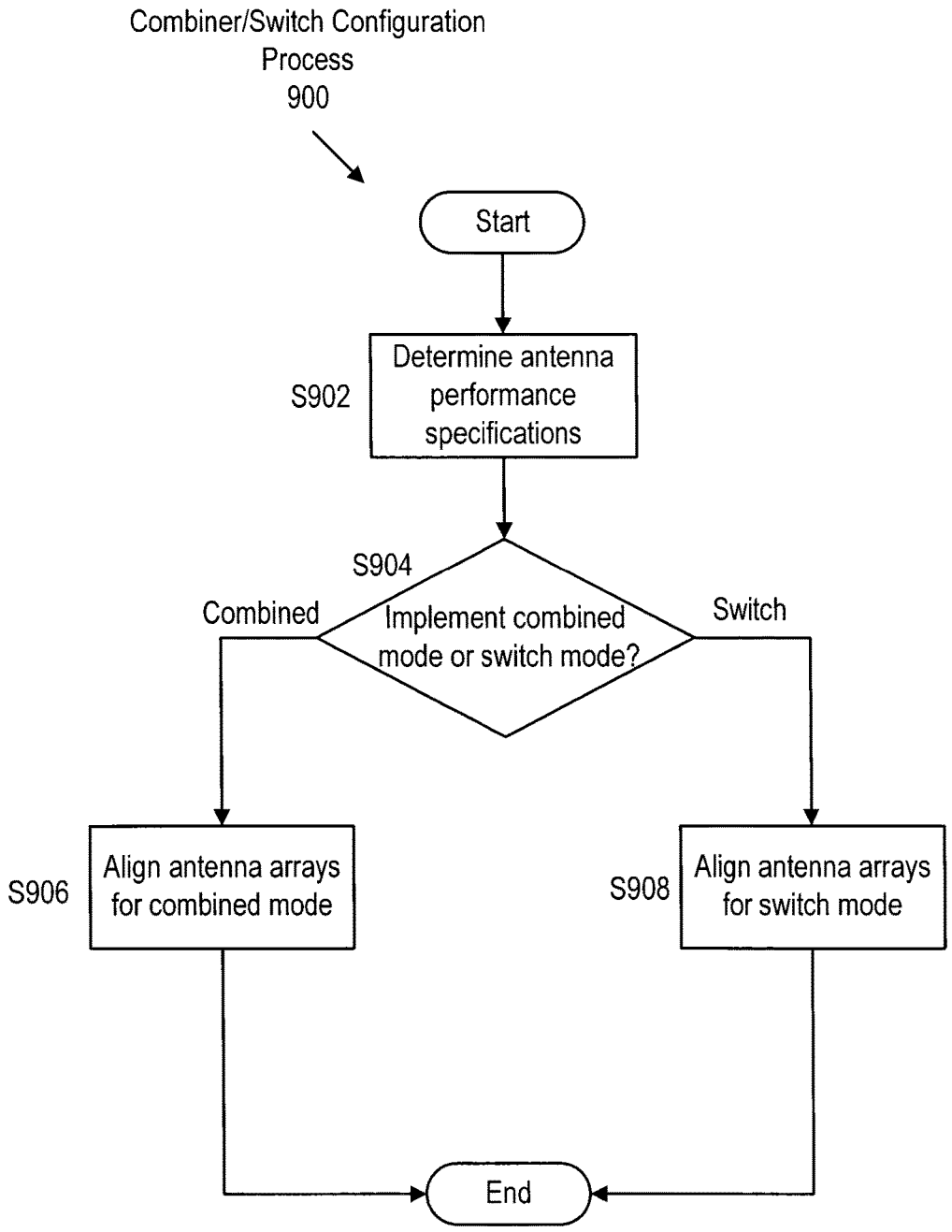
FIG. 9 is an exemplary flowchart of a combiner/switch configuration process, according to certain embodiments.

FIG. 9 is an exemplary flowchart of a combiner/switch configuration process 900, according to certain embodiments. The combiner/switch configuration process 900 is described with respect to the combiner/switch device 200 but can be applied to any of the combiner/switch device implementations described previously herein.

At step S902, the processing circuitry of the radio determines performance specifications for the N antenna arrays. In some implementations, the performance specifications can include spatial diversity specifications, antenna coverage specifications, power consumption specifications, and the like. For example, radios that communicate via the IEEE 802.11ad wireless communication systems are configured with predetermined spatial diversity specifications. In addition, radios having limited battery life and/or processing capabilities may have predetermined power consumption specifications.

At step S904, the processing circuitry of the radio determines which antenna operation mode is to be implemented. For example, it is determined whether the combined antenna mode or the isolated antenna mode is to be implemented based on the performance specifications determined at step S902. For example, the processing circuitry of the radio may implement the combined antenna mode in order to achieve a predetermined antenna coverage pattern obtained by combining the unique antenna patterns from each of the antenna arrays. In addition, it may be determined that the isolated antenna mode is to be implemented to reduce power consumption and/or implement a predetermined antenna search pattern. For example, in one implementation, where the antenna arrays are searching for an incoming beam form, the processing circuitry can cycle between each of the antenna arrays in the isolated antenna mode at a predetermined frequency. If it is determined that the combined antenna mode is to be implemented, then step S906 is performed. Otherwise, if it is determined that the isolated antenna mode is to be implemented, step S908 is performed.

At step S906, if it is determined at step S904 that the combined antenna mode is to be implemented, then the processing circuitry of the radio issues control signals to align the combiner/switch device 200 for the combined antenna mode. In the combined antenna mode, the combiner/switch device 200 operates as a 1:2 Wilkinson combiner that can be a power combiner or a power divider to divide signals being transmitted by the antenna arrays or combine received signals. To align the combiner/switch device 200 for the combined antenna mode, the processing circuitry of the radio can issue a control signal to close or turn on both of the CSD1s 224 of the combiner/switch device 200 so that the combiner/switch device 200 functions as the 1:2 Wilkinson combiner. The CSD2s 226 of the combiner/switch device 200 remain open in the combined antenna mode.

At step S908, if it is determined at step S904 that the isolated antenna mode is to be implemented, then the processing circuitry of the radio issues control signals to align the combiner/switch device 200 for the isolated antenna mode. In the isolated antenna mode, the combiner/switch device 200 operates as a single-pole, double-throw (SPDT) switch that transfers power between the input port 202 and one of the output ports 204 or 206. Therefore, the combiner/switch device 200 isolates an operational antenna array from a non-operational antenna array. To align the combiner/switch device 200 for the isolated antenna mode, the processing circuitry of the radio can issue a control signal to close one of the CSD2s 226 of the combiner/switch device 200 so that the combiner/switch device 200 functions as a SPDT switch. For example, the CSD2 226 connecting the differential signal lines 210 and 212 is shut to align power to an antenna array connected to the output port 204. Likewise, the CSD2 226 connecting the differential signal lines 214 and 216 is shut to align power to the antenna array connected to the output port 206. The CSD1s 224 remain open during the isolated antenna mode, and the CSD2 226 associated with a non-operational antenna array also remains open.

Figure 10:
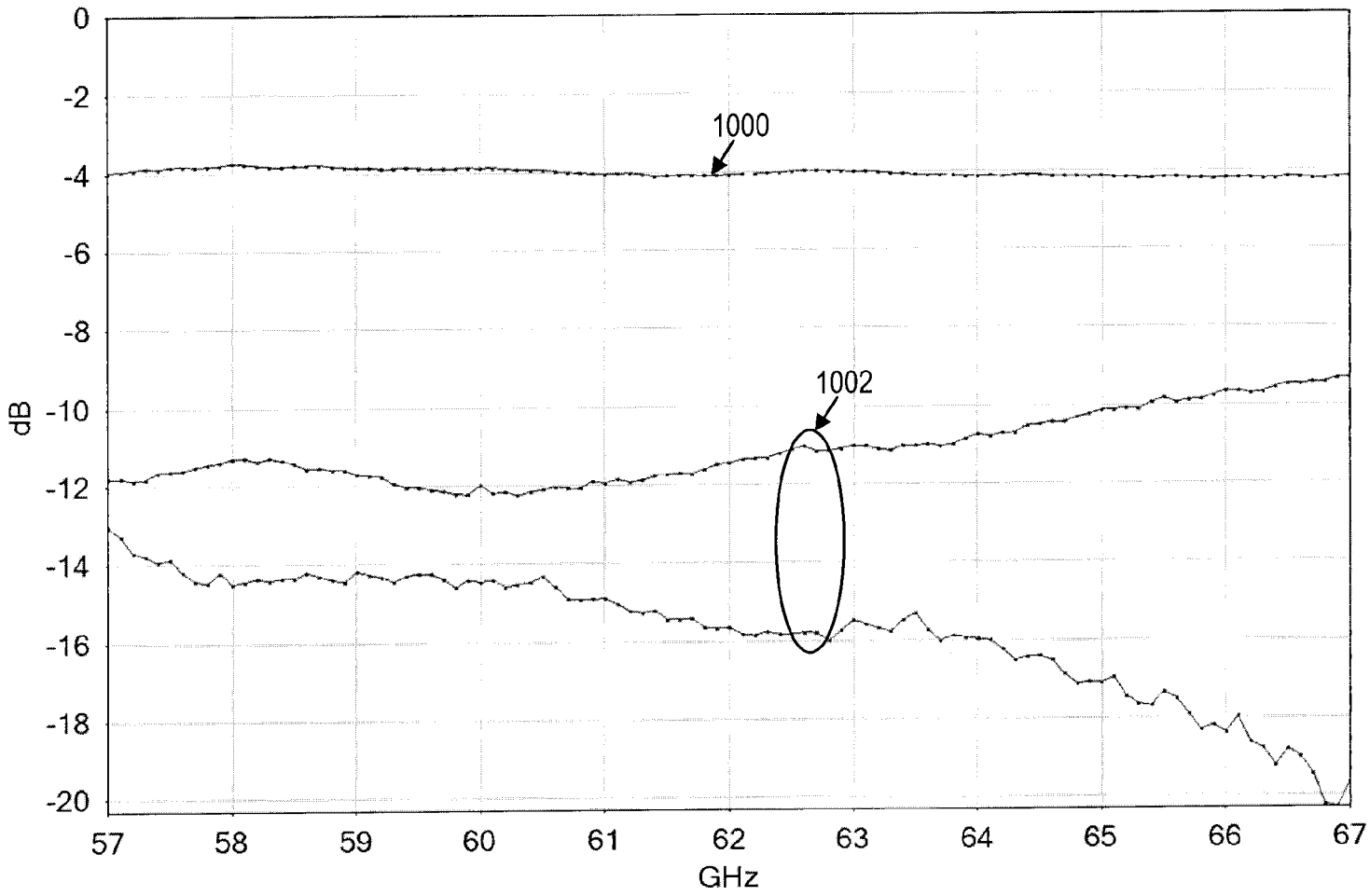
FIG. 10 is an exemplary graph of losses for a device in combined antenna mode, according to certain embodiments.
Figure 11:
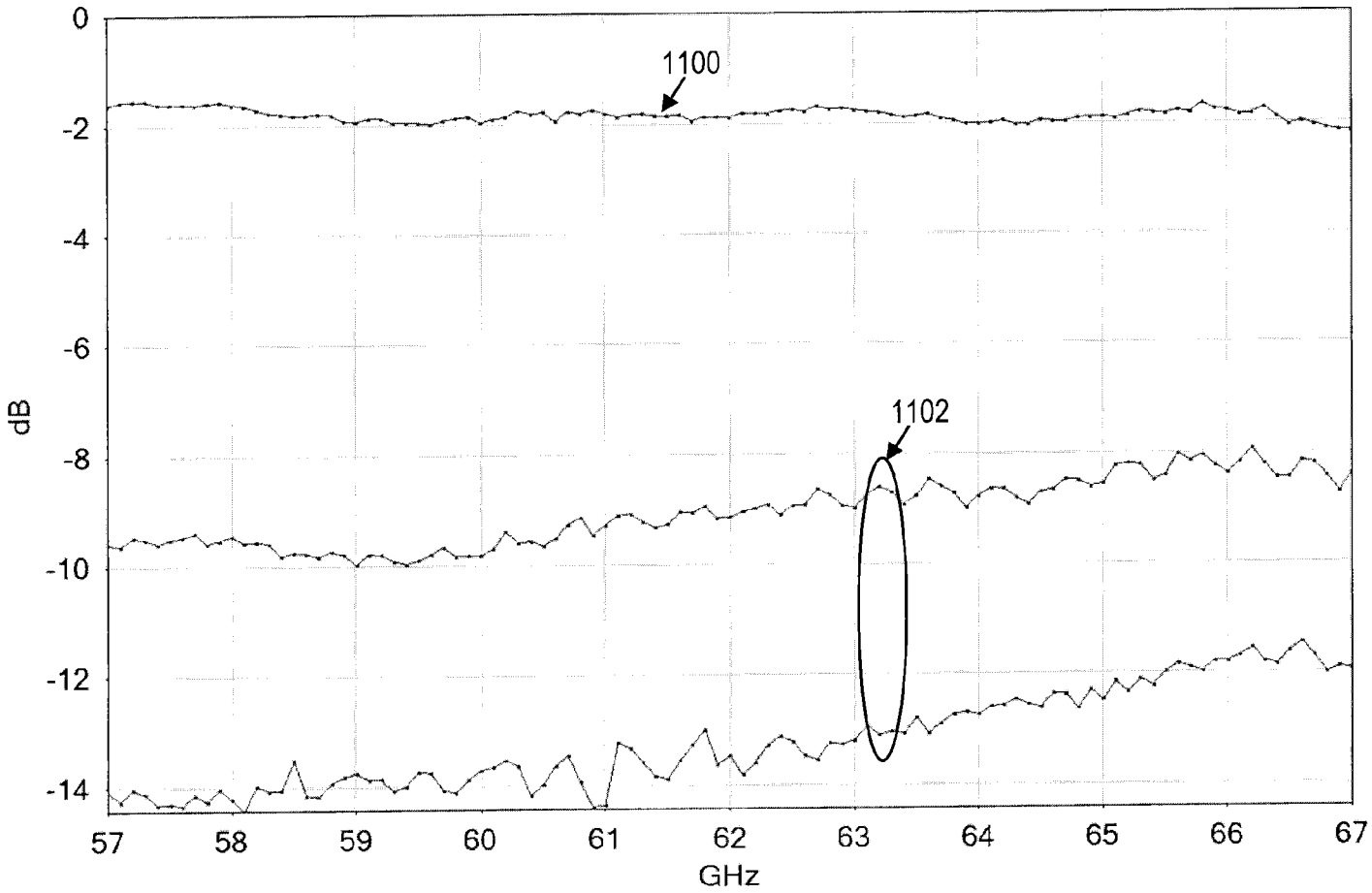
FIG. 11 is an exemplary graph of losses for a device in isolated antenna mode, according to certain embodiments.

FIGS. 10 and 11 are exemplary graphs of losses for a device operating in combined antenna mode or isolated antenna mode. For example, FIG. 10 shows losses for the combiner/switch device 200 operating in the combined antenna mode. The insertion losses 1000 between the input port 202 and one of the output ports 204 and 206 for the combiner/switch device 200 are approximately 4 dB due to splitting the power at the input port 202 equally between the two output ports 204 and 206. In some implementations, ideal insertion losses are equal to 3 dB, so the additional dB of insertion loss is due to additional passive losses in the combiner/switch device 200 when operating in the combined antenna mode. In addition, the matching losses 1002 at the input port 202 and output ports 204 and 206 in an operational range of approximately 57 GHz to 64 GHz are less than 10 dB. In some implementations, maintaining matching losses approximately at or below 10 dB may ensure that amounts of reflection at the combiner/switch device 200 are less than a predetermined threshold.

FIG. 11 shows insertion and matching losses for the combiner/switch device 200 operating in the isolated antenna mode, according to certain embodiments. The insertion losses 1100 between the input port 202 and one of the output ports 204 and 206 for the combiner/switch device 200 are approximately 1.9 dB, which is approximately 2.1 dB less than the insertion losses in the combined antenna mode. The insertion losses are reduced in the isolated antenna mode because all of the power at the input port 202 is transferred to one of the two output ports 204 or 206, which results in a greater amount of power transferred to the operational antenna arrays. In addition, the matching losses 1102 at the input port 202 and output ports 204 and 206 in an operational range of approximately 57 GHz to 64 GHz are approximately less than or equal to 10 dB.

Figure 12:
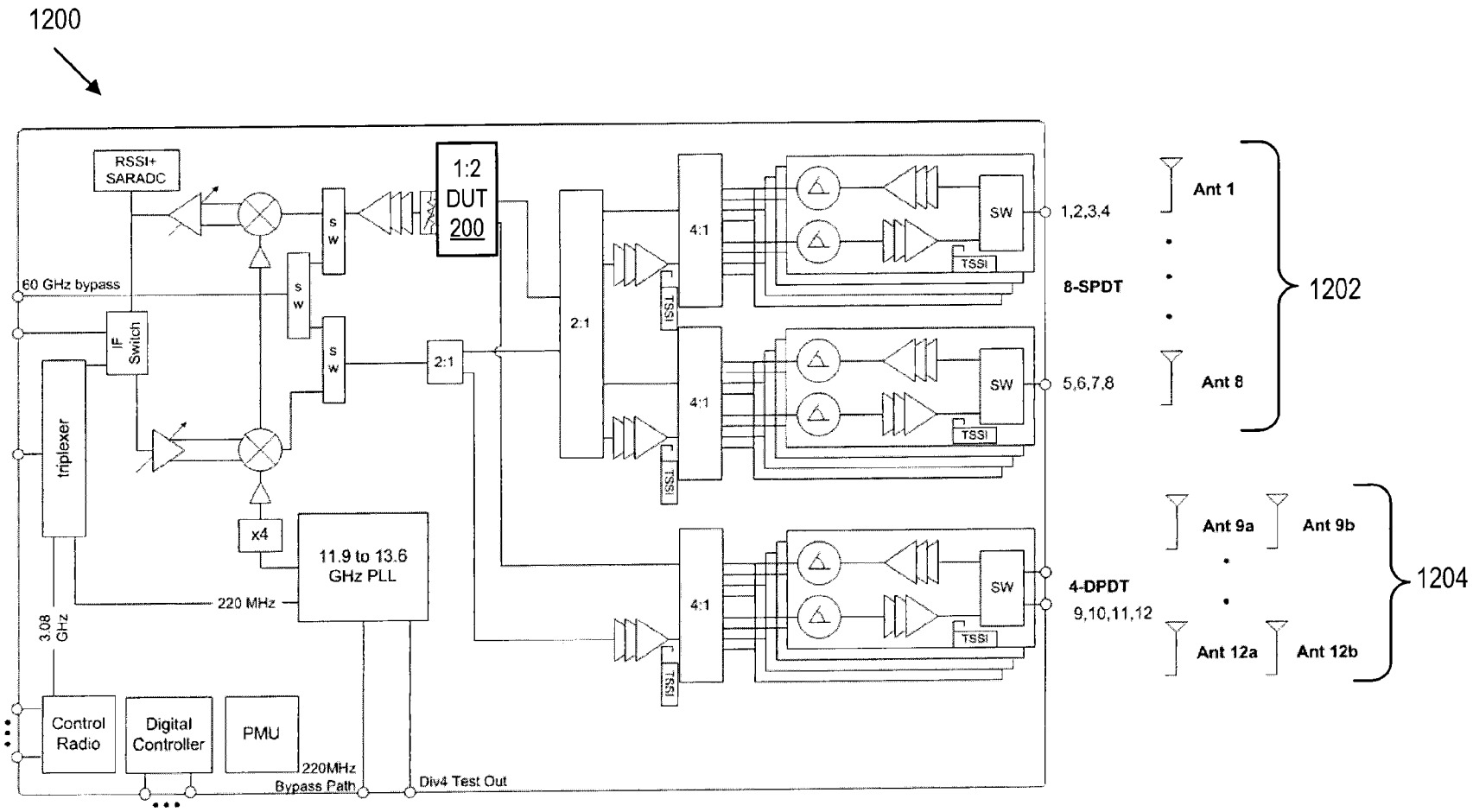
FIG. 12 is an exemplary schematic diagram of hardware implementation of the combiner/switch device, according to certain embodiments.

FIG. 12 is an exemplary schematic diagram of hardware implementation of the combiner/switch device 200, according to certain embodiments. The combiner/switch device 200 is included in a radio chip 1200 that can be implemented in mobile devices, cellular backhaul devices, and the like. The combiner/switch device 200 transmits power to and/or receives power from an eight-element antenna array 1202 and a four-element antenna array 1204 and can operate in combined antenna mode or isolated antenna mode as discussed previously. The eight-element antenna array 1202 includes eight SPDT antennas (1-8), and the four-element antenna array 1204 includes four double-pole, double throw (DPDT) antennas (9*a*-12*a* and 9*b*-12*b*). When operating in the combined antenna mode, the combiner/switch device 200 divides power equally between the eight-element antenna array 1202 and the four-element antenna array 1204, which means that antennas 1-8 and either antennas 9*a*-12*a* or 9*b*-12*b* are operational. When operating in the isolated antenna mode, only one of the antenna arrays is operational, which means that the combiner/switch device 200 provides power to or receives power from either the eight-element antenna array 1202 or the four-element antenna array 1204, which means that only one of antennas 1-8, antennas 9*a*-12*a*, or antennas 9*b*-12*b* are operational.

Aspects of the disclosure are directed to a combiner/switch device that includes a reconfigurable 1:N Wilkinson combiner and switch. The implementations of the combiner/switch device described herein allow a single radio chip to be used with different types of antennas without redesigning the radio chip. For example, by using the combiner/switch device, a radio chip having twelve antenna ports can be configured with an eight-element antenna array and a four-element antenna array. The chip can also be configured with three four-element antenna arrays pointing in three different directions, according to certain embodiments.

A hardware description of a device 1350 for performing one or more of the embodiments described herein is described with reference to FIG. 13. The hardware described by FIG. 13 can apply to off-chip processing components of a radio as well as to components of a mobile device, cellular backhaul device, and the like. When the device 1350 is programmed to perform the processes related to video editing described herein, the device 1350 becomes a special purpose device.

The device 1350 includes a CPU 1300 that perform the processes described herein. The process data and instructions may be stored in memory 1302. These processes and instructions may also be stored on a storage medium disk 1304 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the device 1350 communicates.

Further, the claimed advancements may be provided as a utility application, background daemon, or component of an operating system, or combination thereof, executing in conjunction with CPU 1300 and an operating system such as Microsoft Windows, UNIX, Solaris, LINUX, Apple MAC-OS and other systems known to those skilled in the art.

CPU 1300 may be a Xenon or Core processor from Intel of America or an Opteron processor from AMD of America, or may be other processor types that would be recognized by one of ordinary skill in the art. Alternatively, the CPU 1300 may be implemented on an FPGA, ASIC, PLD or using discrete logic circuits, as one of ordinary skill in the art would recognize. Further, CPU 1300 may be implemented as multiple processors cooperatively working in parallel to perform the instructions of the inventive processes described above.

Figure 13:
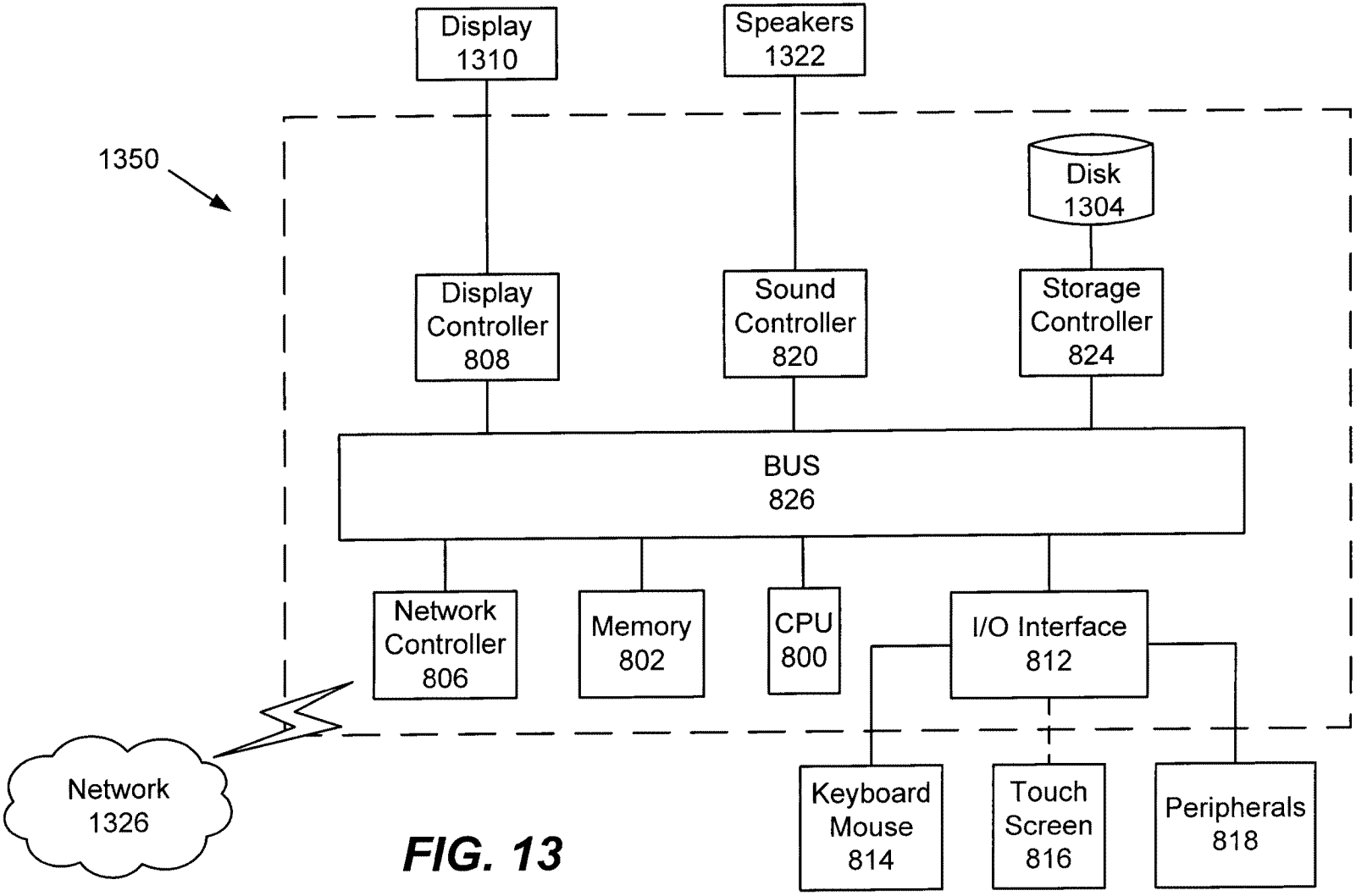
FIG. 13 is an exemplary illustrates a non-limiting example of a device, according to certain embodiments.

The device 1350 in FIG. 13 also includes a network controller 1306, such as an Intel Ethernet PRO network interface card from Intel Corporation of America, for interfacing with network 1326. As can be appreciated, the network 1326 can be a public network, such as the Internet, or a private network such as an LAN or WAN network, or any combination thereof and can also include PSTN or ISDN sub-networks. The network 1326 can also be wired, such as an Ethernet network, or can be wireless such as a cellular network including EDGE, 3G and 4G wireless cellular systems. The wireless network can also be Wi-Fi, Bluetooth, or any other wireless form of communication that is known.

The device 1350 further includes a display controller 1308, such as a NVIDIA GeForce GTX or Quadro graphics adaptor from NVIDIA Corporation of America for interfacing with display 1310 of the device 1350, such as an LCD monitor. A general purpose I/O interface 1312 at the device 1350 interfaces with a keyboard and/or mouse 1314 as well as a touch screen panel 1316 on or separate from display 1310. General purpose I/O interface 1312 also connects to a variety of peripherals 1318 including printers and scanners.

A sound controller 1320 is also provided in the device 1350, such as Sound Blaster X-Fi Titanium from Creative, to interface with speakers/microphone 1322 thereby providing sounds and/or music.

The general purpose storage controller 1324 connects the storage medium disk 1304 with communication bus 1326, which may be an ISA, EISA, VESA, PCI, or similar, for interconnecting all of the components of the device 1350. A description of the general features and functionality of the display 1310, keyboard and/or mouse 1314, as well as the display controller 1308, storage controller 1324, network controller 1306, sound controller 1320, and general purpose I/O interface 1312 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset, as shown on FIG. 14.

Figure 14:
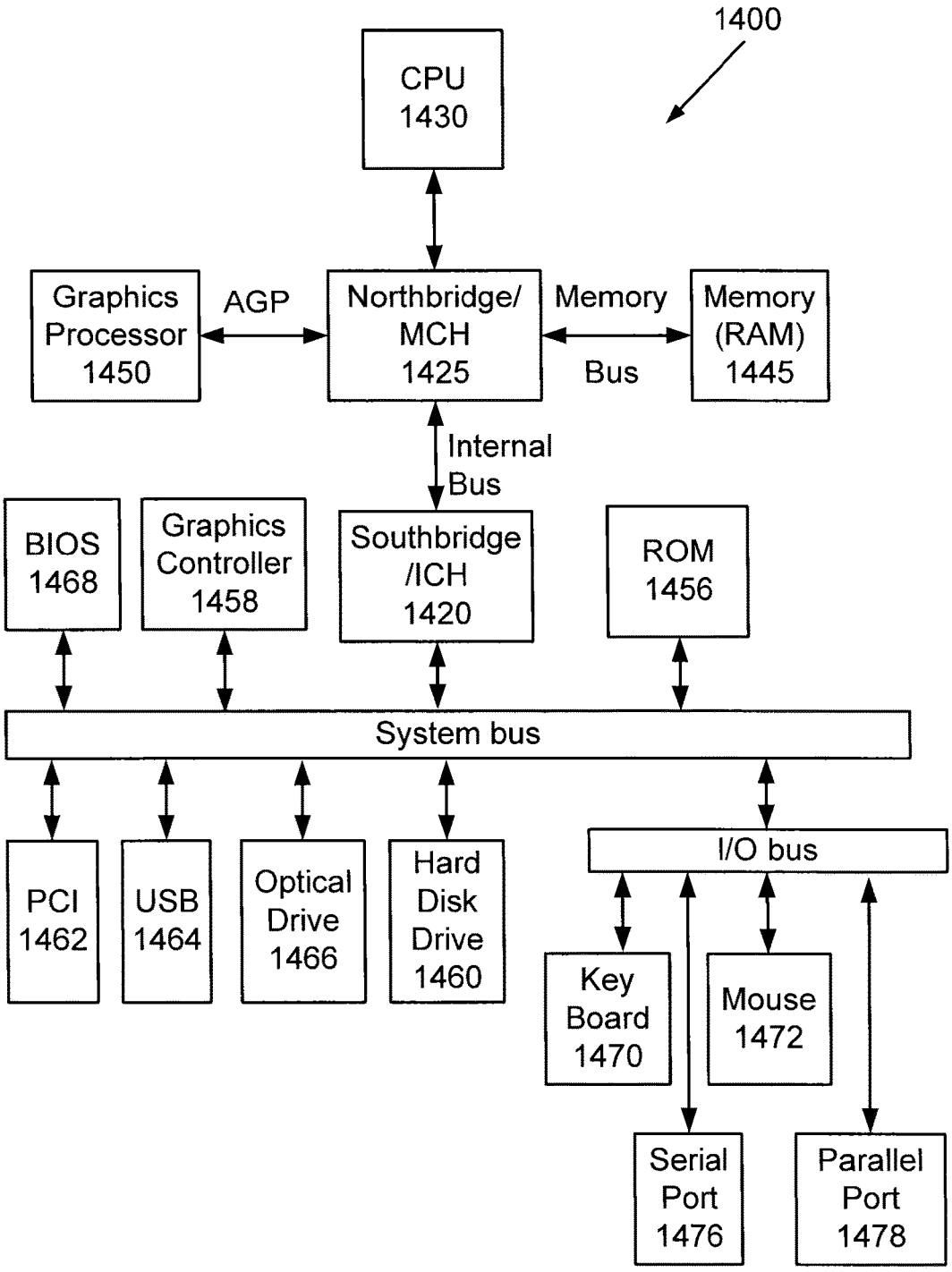
FIG. 14 is an exemplary schematic diagram of a data processing system, according to certain embodiments.

FIG. 14 shows a schematic diagram of a data processing system, according to certain embodiments, for performing the combiner/switch configuration process 900. The data processing system is an example of a computer in which code or instructions implementing the processes of the illustrative embodiments may be located.

In FIG. 14, data processing system 1400 employs a hub architecture including a north bridge and memory controller hub (NB/MCH) 1425 and a south bridge and input/output (I/O) controller hub (SB/ICH) 1420. The central processing unit (CPU) 1430 is connected to NB/MCH 1425. The NB/MCH 1425 also connects to the memory 1445 via a memory bus, and connects to the graphics processor 1450 via an accelerated graphics port (AGP). The NB/MCH 1425 also connects to the SB/ICH 1420 via an internal bus (e.g., a unified media interface or a direct media interface). The CPU Processing unit 1430 may contain one or more processors and even may be implemented using one or more heterogeneous processor systems.

Figure 15:
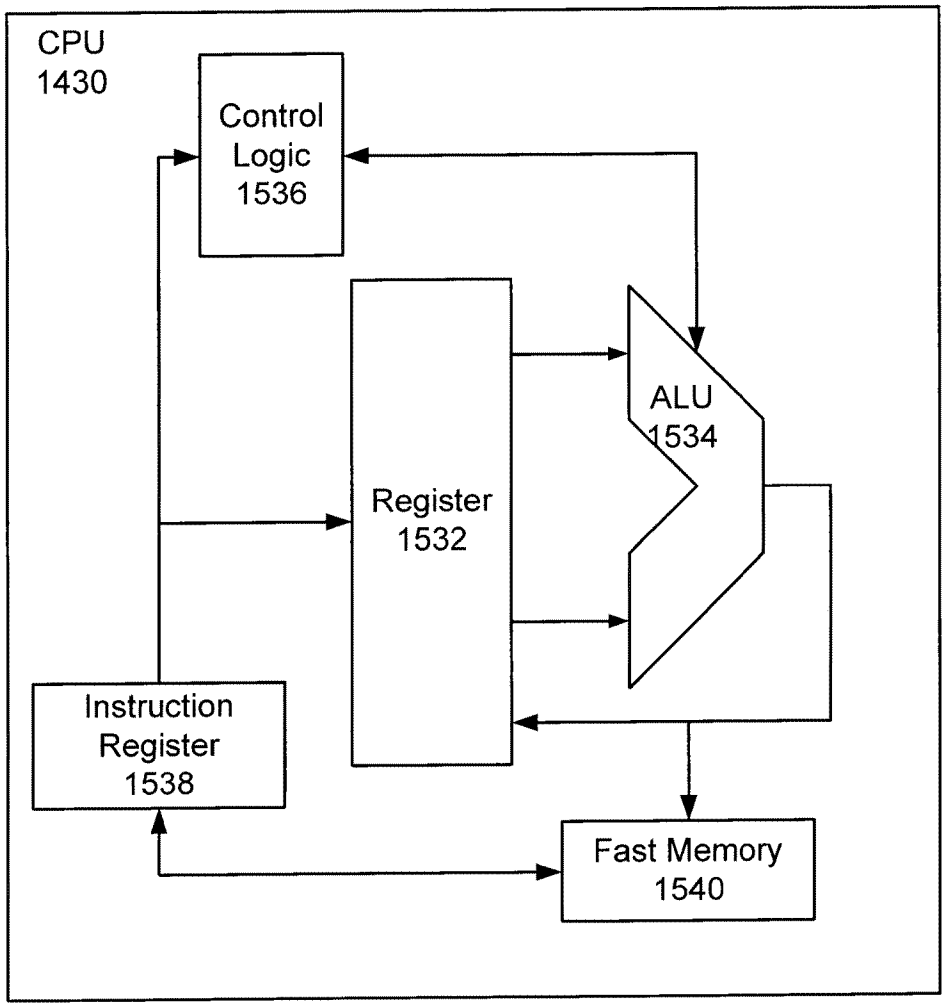
FIG. 15 is an exemplary schematic diagram of a processor, according to certain embodiments.

For example, FIG. 15 shows one implementation of CPU 1430. In one implementation, the instruction register 1538 retrieves instructions from the fast memory 1540. At least part of these instructions are fetched from the instruction register 1538 by the control logic 1536 and interpreted according to the instruction set architecture of the CPU 1430. Part of the instructions can also be directed to the register 1532. In one implementation the instructions are decoded according to a hardwired method, and in another implementation the instructions are decoded according a microprogram that translates instructions into sets of CPU configuration signals that are applied sequentially over multiple clock pulses. After fetching and decoding the instructions, the instructions are executed using the arithmetic logic unit (ALU) 1534 that loads values from the register 1532 and performs logical and mathematical operations on the loaded values according to the instructions. The results from these operations can be feedback into the register and/or stored in the fast memory 1540.

According to certain implementations, the instruction set architecture of the CPU 1430 can use a reduced instruction set architecture, a complex instruction set architecture, a vector processor architecture, a very large instruction word architecture. Furthermore, the CPU 1430 can be based on the Von Neuman model or the Harvard model. The CPU 1430 can be a digital signal processor, an FPGA, an ASIC, a PLA, a PLD, or a CPLD. Further, the CPU 1430 can be an x86 processor by Intel or by AMD; an ARM processor, a Power architecture processor by, e.g., IBM; a SPARC architecture processor by Sun Microsystems or by Oracle; or other known CPU architecture.

Referring again to FIG. 14, the data processing system 1400 can include that the SB/ICH 1420 is coupled through a system bus to an I/O Bus, a read only memory (ROM) 1456, universal serial bus (USB) port 1464, a flash binary input/output system (BIOS) 1468, and a graphics controller 1458. PCI/PCIe devices can also be coupled to SB/ICH YYY through a PCI bus 1462.

The PCI devices may include, for example, Ethernet adapters, add-in cards, and PC cards for notebook computers. The Hard disk drive 1460 and CD-ROM 1466 can use, for example, an integrated drive electronics (IDE) or serial advanced technology attachment (SATA) interface. In one implementation the I/O bus can include a super I/O (SIO) device.

Further, the hard disk drive (HDD) 1460 and optical drive 1466 can also be coupled to the SB/ICH 1420 through a system bus. In one implementation, a keyboard 1470, a mouse 1472, a parallel port 1478, and a serial port 1476 can be connected to the system bust through the I/O bus. Other peripherals and devices that can be connected to the SB/ICH 1420 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry, or based on the requirements of the intended back-up load to be powered.

The functions and features described herein may also be executed by various distributed components of a system. For example, one or more processors may execute these system functions, wherein the processors are distributed across multiple components communicating in a network. The distributed components may include one or more client and server machines, which may share processing in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein. In other alternate embodiments, processing features according to the present disclosure may be implemented and commercialized as hardware, a software solution, or a combination thereof. Moreover, instructions corresponding to the combiner/switch configuration process 900 in accordance with the present disclosure could be stored in a thumb drive that hosts a secure process.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components. The functions, processes and algorithms described herein may be performed in hardware or software executed by hardware, including computer processors and/or programmable circuits configured to execute program code and/or computer instructions to execute the functions, processes and algorithms described herein. Additionally, an implementation may be performed on modules or hardware not identical to those described. Accordingly, other implementations are within the scope that may be claimed.

The invention claimed is:

1. An electronic device comprising:
circuitry configured to
determine an antenna operation mode for one or more antenna arrays;
control the one or more antenna arrays to operate in a combined antenna mode via a Wilkinson combiner by aligning the Wilkinson combiner to the one or more antenna arrays via a set of core switching devices; and
control the one or more antenna arrays to operate in an isolated antenna mode via a single-pole, multi-throw switch.

2. The device of claim 1, wherein the circuitry is further configured to control the one or more antenna arrays to operate in the combined antenna mode based on at least one of antenna coverage or spatial diversity specifications.

3. The device of claim 1, wherein the circuitry is further configured to configure the Wilkinson combiner as a power divider or a power combiner.

4. The device of claim 1, wherein the circuitry is further configured to perform bidirectional power transfer.

5. The device of claim 4, wherein the circuitry is further configured to align the one or more antenna arrays as a transmitter or a receiver.

6. The device of claim 1, wherein the circuitry is further configured to control the one or more antenna arrays to operate in the isolated antenna mode to reduce power consumption and antenna losses.

7. An electronic device comprising:
circuitry configured to
determine an antenna operation mode for one or more antenna arrays;
control the one or more antenna arrays to operate in a combined antenna mode via a Wilkinson combiner; and
control the one or more antenna arrays to operate in the isolated antenna mode via a single-pole, multi-throw switch implemented by a set of core switching devices.

8. The device of claim 7, wherein the circuitry is further configured to turn on one core switching device from the set of core switching devices corresponding to a selected antenna port to align power to an operational antenna array.

9. The device of claim 8, wherein the circuitry is further configured to isolate the operational antenna array from one or more non-operational antenna arrays.

10. An electronic device comprising:
circuitry configured to
determine an antenna operation mode for one or more antenna arrays;
control the one or more antenna arrays to operate in a combined antenna mode via a Wilkinson combiner; and
control the one or more antenna arrays to operate in an isolated antenna mode via a single-pole, multi-throw switch, wherein
the circuitry is further configured to control the antenna operation mode of the one or more antenna arrays via at least one core switching device including a deep N-well NFET.

11. The device of claim 10, wherein the deep N-well NFET includes a high resistance p-substrate ring to increase an off-state impedance of the at least one core switching device.

12. The device of claim 10, wherein the deep N-well NFET includes an additional buried p-substrate bias to reduce an on-state impedance of the at least one core switching device.

13. The device of claim 1, wherein the circuitry is further configured for differential or single-ended operations.

14. An electronic device comprising:
circuitry configured to
determine an antenna operation mode for one or more antenna arrays;
control the one or more antenna arrays to operate in a combined antenna mode via a Wilkinson combiner; and
control the one or more antenna arrays to operate in an isolated antenna mode via a single-pole, multi-throw switch, wherein
input and output impedances of the circuitry are matched in the combined antenna mode and the isolated antenna mode.

15. The device of claim 14, wherein the input and output impedances of the circuitry are matched based on on-state impedances of one or more core switching devices.

16. The device of claim 14, wherein the input and output impedances are matched to 0.8 times a system impedance in the combined antenna mode.

17. The device of claim 14, wherein the input and output impedances are matched to values between the system impedance and 1.5 times the system impedance.

* * * * *